US006119419A

United States Patent [19]

Milanian

[11] Patent Number: 6,119,419

[45] Date of Patent: Sep. 19, 2000

[54] INTEGRATED BUILDING COMPLEX CONSISTING OF SHIP AND ICEBERG BUILDING STRUCTURES CONNECTED BY TUNNELS

[76] Inventor: Cyrus Milanian, 2070 SE. 16th St., Pompano Beach, Fla. 33062-7608

[21] Appl. No.: 09/280,405

[22] Filed: Mar. 29, 1999

Related U.S. Application Data

[63] Continuation-in-part of application No. 09/184,603, Nov. 2, 1998.

[60] Provisional application No. 60/075,354, Feb. 20, 1998.

[51] Int. Cl.[7] ..... E04H 3/02

[52] U.S. Cl. ..... 52/234; 52/236.1; 52/236.3; 472/136; D25/11

[58] Field of Search ..... 52/236.1, 236.3, 52/234, 174, 169.3; 472/57, 62, 65, 75, 136; D25/7, 11

[56] References Cited

U.S. PATENT DOCUMENTS

| | | | |
|---|---|---|---|
| D. 83,733 | 3/1931 | Lease | D25/11 X |
| 797,095 | 8/1905 | Boyce . | |
| 817,577 | 4/1906 | Miller . | |
| 872,627 | 12/1907 | Keen . | |
| 1,400,314 | 12/1921 | Raymond | 472/136 X |
| 3,422,581 | 1/1969 | Allen | 52/174 X |
| 5,219,315 | 6/1993 | Fuller et al. . | |
| 5,336,132 | 8/1994 | Murakami . | |
| 5,564,239 | 10/1996 | Mitsis | 52/236.1 |
| 5,669,821 | 9/1997 | Prather et al. . | |

*Primary Examiner*—Christopher T. Kent
*Attorney, Agent, or Firm*—Oltman, Flynn & Kubler

[57] ABSTRACT

A fully integrated building complex comprising a body of water, a first housing structured to resemble the Titanic and a generally domed-shaped second housing structured to resemble an iceberg. The first and second housings are each situated within the body of water so that a first portion is disposed within the body of water, resting on the bottom thereof, and a second portion is disposed above the body of water. The interior of the first and second housings are divided into a plurality of levels and may include an entranceway/lobby, guest quarters, restaurants and entertainment facilities, a casino and other hotel amenities, such as health clubs swimming pools, beauty salons, retail shops, etc. Access between the first housing and the shore is provided by a generally tubular-shaped enclosed gangway having at least one conveyor belt-like people mover. Access between the second housing and the shore is provided by a generally tubular-shaped enclosure having one or more motorized or tram-like vehicles operating therein. Access between the first and second housings is provided by a generally tubular-shaped tunnel having one or more motorized or tram-like vehicles operating therein.

5 Claims, 7 Drawing Sheets

INTEGRATED BUILDING COMPLEX CONSISTING OF SHIP AND ICEBERG BUILDING STRUCTURES CONNECTED BY TUNNELS

This application is a continuation-in-part of application Ser. No. 09/184,603, filed Nov. 2, 1998 which claims the benefit of Provisional Application Ser. No. 60/075,354 filed Feb. 20, 1998.

BACKGROUND OF THE INVENTION

1. Field of the Invention

The present invention relates to building structures and, more particularly, to an integrated building complex consisting of a ship, which is a replica of the Titanic and an iceberg.

2. Description of the Related Art

Creating innovative building structures is a constant challenge for architects, engineers and builders. Over the past several years restaurants, hotels and other buildings have been created in a wide variety of structures. For instance, restaurants have been structured to resemble ships and castles, hotels have been structured to resemble swans and dolphins and buildings have been structured to house amusement rides which simulate boats, planes, cars, etc. and resemble particular scenes or themes. A common feature underlying most of these prior art building structures is the fact that they are comprised of a single structure designed to perform a specific function.

Applicant has discovered the need for a fully integrated building complex consisting of a plurality of such innovative building structures structured to perform a multitude of functions. Any such complex should preferably be structured to follow a single aesthetic theme and be all inclusive, that is all functions and amenities required by a visitor should be available within the complex. Specifically, applicant has discovered the need for a fully integrated building complex, situated in a lake or other body of water, consisting of a plurality of interconnected multi-function structures, one such structure being a ship, which, externally, is a replica of the Titanic, and another such structure being a replica of the iceberg which was struck by the Titanic. The present invention is particularly suited to overcome those problems which remain in the art in a manner not previously known.

SUMMARY OF THE INVENTION

The present invention is directed towards a new and improved fully integrated building complex comprising a body of water, a first housing structured to resemble the Titanic and a generally domed-shaped second housing structured to resemble an iceberg. The first and second housings are each situated within the body of water so that a first portion is disposed within the body of water resting on the bottom thereof, and a second portion is disposed above the body of water. The second housing includes a plurality of generally vertically disposed, annular-shaped columns and generally horizontally disposed support beams extending between the columns to provide structural support for the generally domed-shaped structure and the floors therein. Additionally, each column includes a plurality of elevators for transporting people between the several levels and a plurality of conduits for running electrical wires and plumbing pipes. The interior of the first and second housings are divided into a plurality of levels and may include an entranceway/lobby, guest quarters, restaurants and entertainment facilities, a casino and other hotel amenities, such as health clubs swimming pools, beauty salons, retail shops, etc. Access to the first housing is provided by a generally tubular-shaped enclosed gangway having a first end interconnected to the first housing, an opposite second end interconnected to the shore and at least one conveyor belt-like people mover extending therebetween. Access to the second housing is provided by a generally tubular-shaped enclosure having a first end interconnected to the second housing, an opposite second end interconnected to the shore and one or more motorized or tram-like vehicles operating therebetween. Access between the first and second housings is provided by a generally tubular-shaped tunnel having a first end interconnected to the first housing, an opposite second end interconnected to the second housing and one or more motorized or tram-like vehicles operating therebetween.

It is an object of the present invention to provide a new and improved integrated building complex which has all the advantages of the prior art devices and none of the disadvantages.

It is another object of the present invention to provide such a complex which comprises a plurality of innovative building structures structured to perform a multitude of functions.

It is also an object of the present invention to provide such a complex which is structured to follow a single aesthetic theme.

It is yet another object of the present invention to provide such a complex which provides all functions and amenities required by a visitor.

It is yet a further object of the present invention to provide such a complex which is situated in a lake or other body of water and consists of a plurality of interconnected multi-function structures, one such structure being a replica of the Titanic, and another such structure being a replica of the iceberg which was struck by the Titanic.

These and other objects and advantages of the present invention will become more readily apparent in the description which follows.

BRIEF DESCRIPTION OF THE DRAWINGS

For a fuller understanding of the nature of the present invention, reference should be had to the following detailed description, taken in connection with the accompanying drawings in which.

Like reference numerals refer to like parts throughout the several views of the drawings.

DETAILED DESCRIPTION OF THE PREFERRED EMBODIMENT

Figure 1:
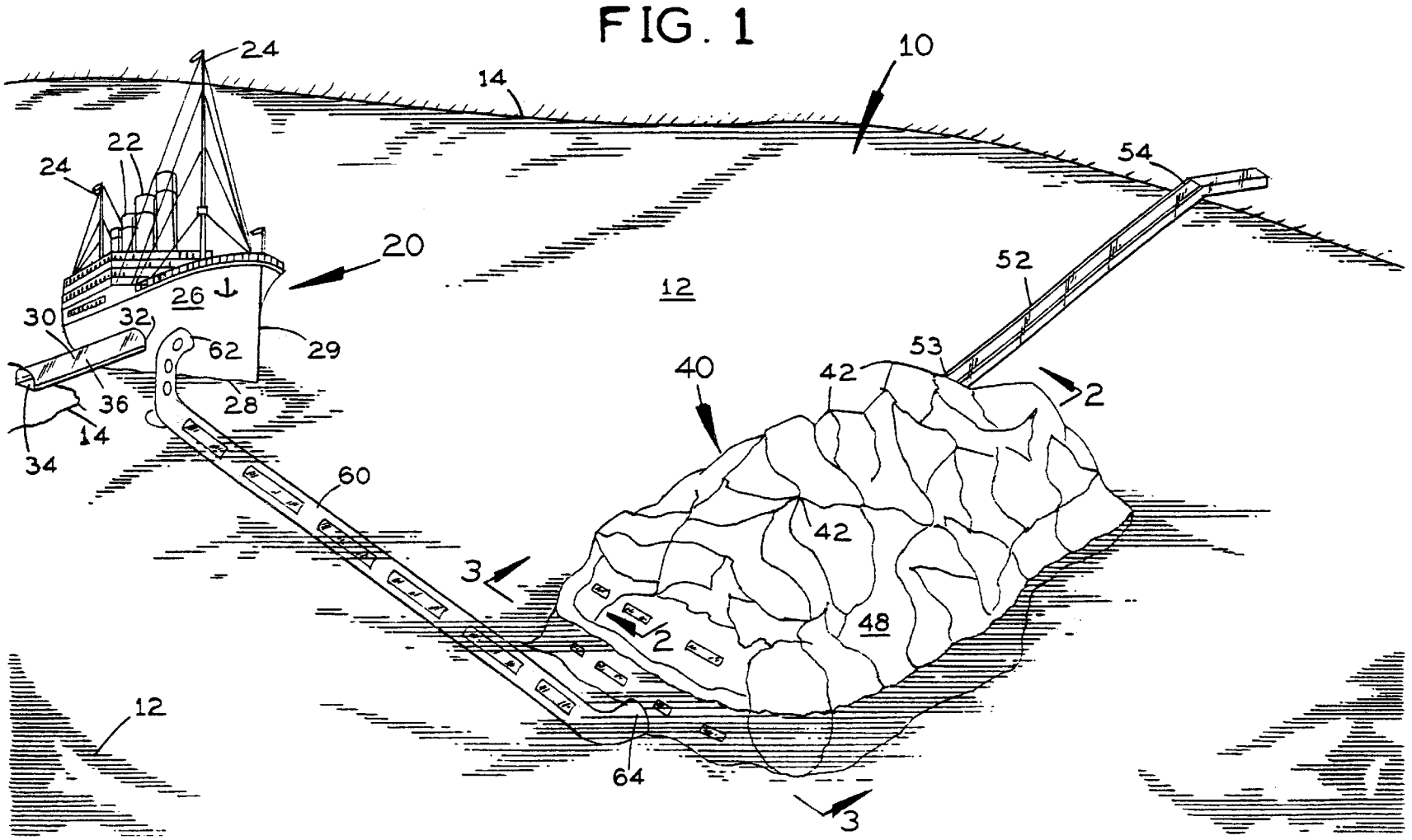
FIG. 1 is a perspective view of the integrated building complex of the present invention.

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

As shown in FIGS. 1–9, the present invention is directed towards a new and improved fully integrated building complex 10 comprising a body of water 12, a first housing 20 structured to resemble a ship and a generally domed-shaped second housing 40 structured to resemble an iceberg. The body of water 12 is preferably a man-made or natural lake approximately seven feet deep, ½ mile long and ¼ mile wide. Of course it can be appreciated that the depth, length and width of the body of water 12 may vary as necessary. The surface of the body of water 12 is maintained in slight motion by coventional means known in the art to enhance the perception that the first housing 20 is afloat on the body of water 12.

The exterior of the first housing 20 is preferably constructed to resemble the Titanic. As such, the first housing 20 includes four fifty foot smoke stacks 22, forward and rear masts 24 and rivet heads (not shown) along the exterior sidewalls 26 to replicate the means for securing the Titanic's hull's steel plates together. However, the first housing 20 is constructed of conventional steel frame and reinforced concrete.

The first housing 20 is situated within the body of water 12 so that a first portion 28 is disposed within the body of water 12 resting on the bottom 45*a* thereof, and a second portion 29 is disposed above the body of water 12. The precise apportionment of the first housing 20 between the first 28 and second portions 29 may vary to accommodate the final detailed design criteria.

The interior of the first housing 20 will be divided into a plurality decks and may include an entranceway/lobby, guest quarters, restaurants and entertainment facilities and other hotel amenities, such as health clubs swimming pools, beauty salons, retail shops, etc. Additionally, a casino or other gambling facility may be provided if located in an area where such facility is permissible. It should be appreciated that the precise configuration of the first housing 20 and the facilities included therein may vary to accommodate the specific usage desired.

Access to the first housing 20 is provided by a first generally tubular-shaped enclosed gangway 30 having a first end 32 interconnected to the first housing 20 and an opposite second end 34 interconnected to the shore 14. The enclosure encompassing the gangway 30 is preferably transparent so that persons entering and exiting the first housing 20 may view the entire complex 10 from therein. At least one conveyor belt-like people mover 36 inside the gangway 30 facilitates the ingress into and egress out of the first housing 20. A second gangway and people mover (not shown) may be provided, if necessary, to further facilitate such ingress and egress.

Moreover, other conventional entrance and exiting means may be provided in addition to or in lieu of the gangways and people movers.

Figure 2:
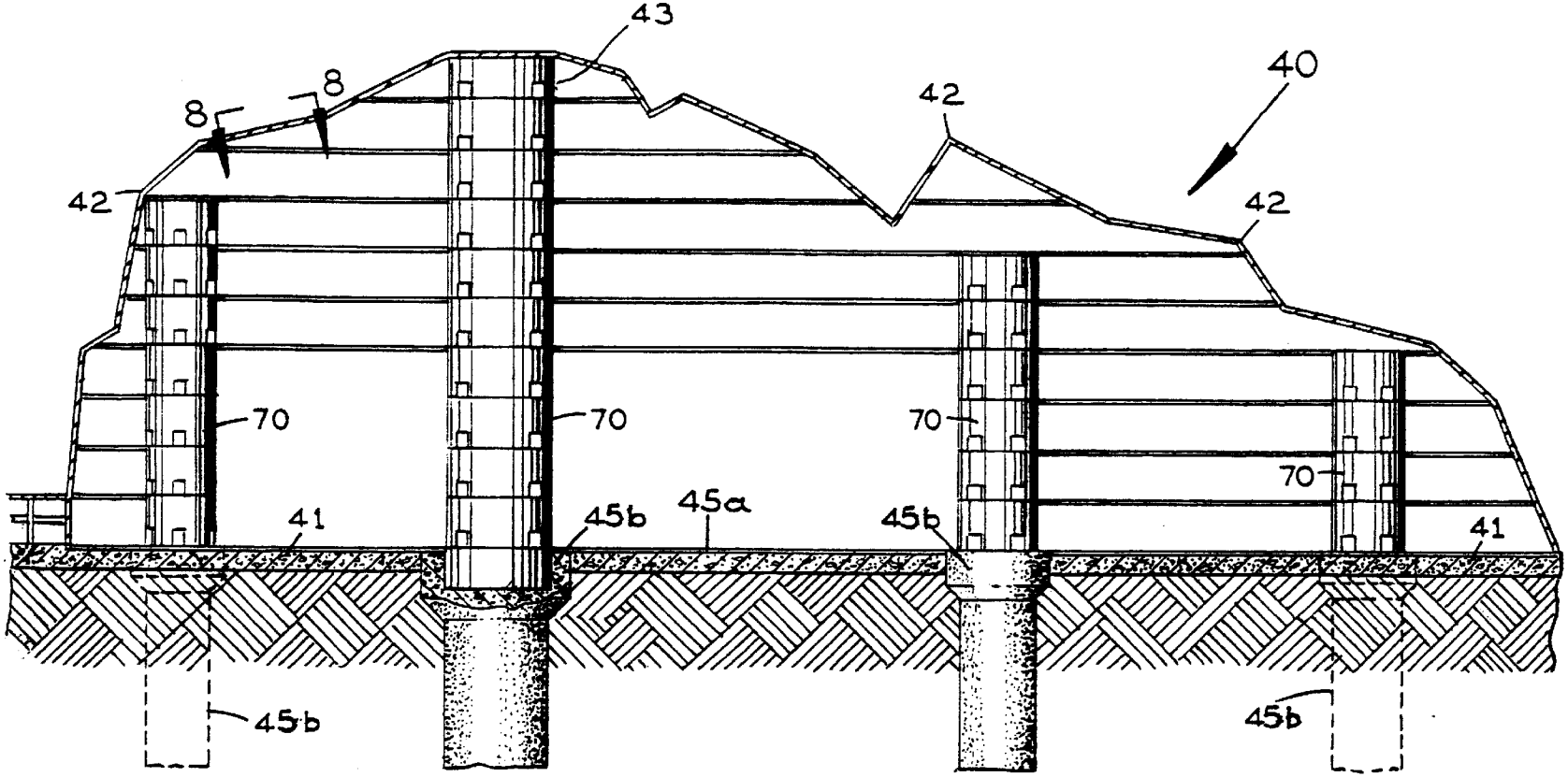
FIG. 2 is a cross sectional view of the second housing, taken across the line 2—2 of FIG. 1, showing the foundation and the columns.
Figure 3:
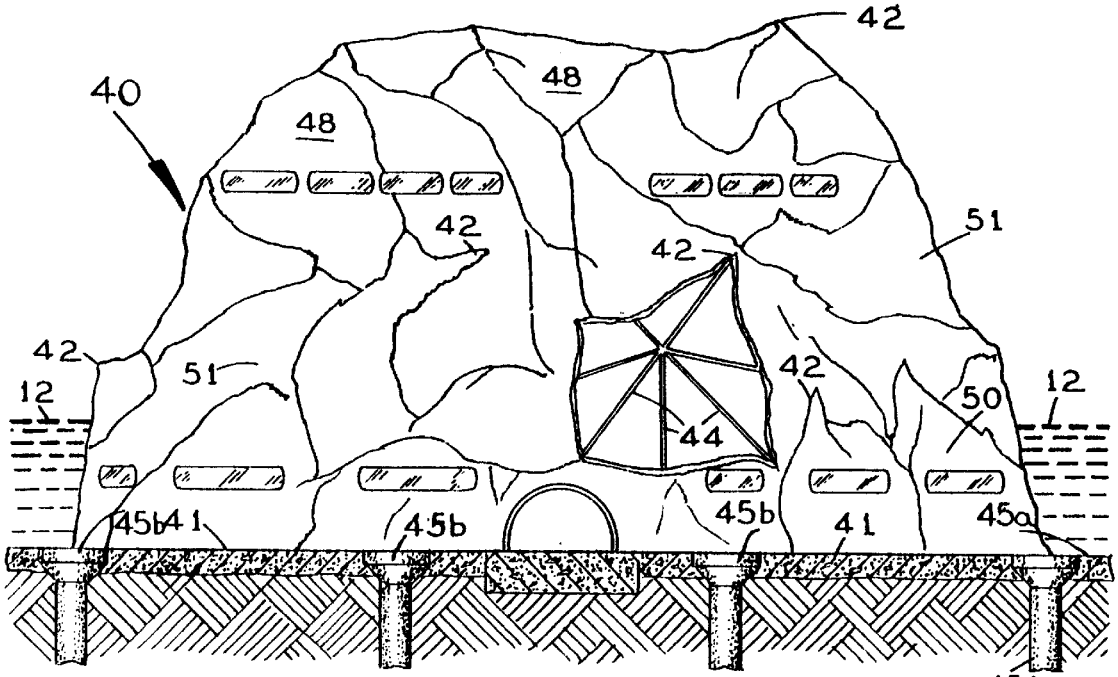
FIG. 3 is a side elevation view of the second housing, taken across the line 3—3 of FIG. 1, showing the foundation and the exterior surface of the second housing.
Figure 8:
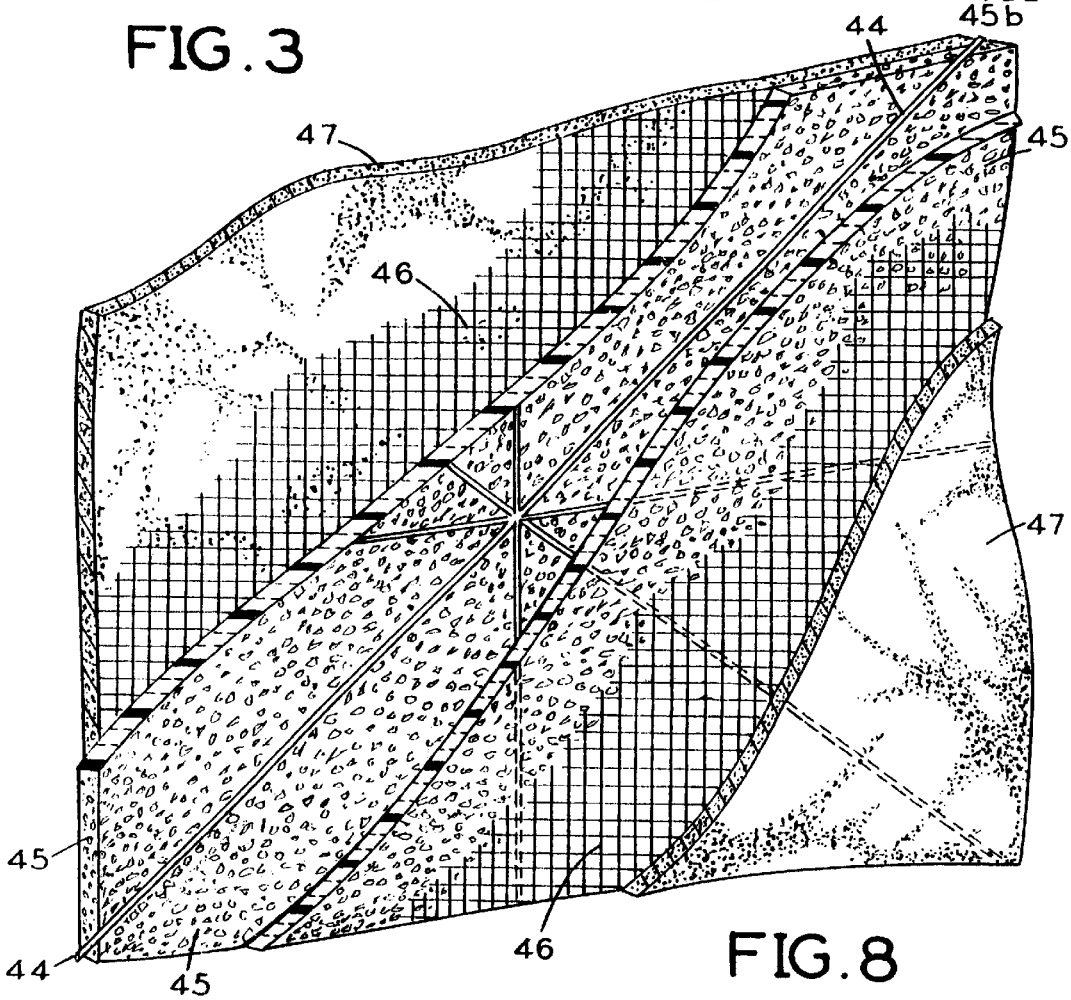
FIG. 8 is a cross sectional view of the second housing, taken across the line 8—8 of FIG. 2, showing the construction of the outer surface.

The second housing 40 is structured to resemble an iceberg. As such, it is generally domed-shaped with an irregular contoured, jagged exterior 42. Referring now to FIGS. 3 and 8, the second housing 40 is constructed of steel 44 surrounded by layers of insulation 45, wire mesh 46 and reinforced concrete 47. The second housing 40 includes an outermost layer of reflective glass 48 to simulate the look of ice. Referring to FIG. 2, the foundation 41 of the second housing 40 is situated within the body of water 12 and may be supported by platforms 45 secured to the floor 45*a* of the body of water 12.

Figure 4:
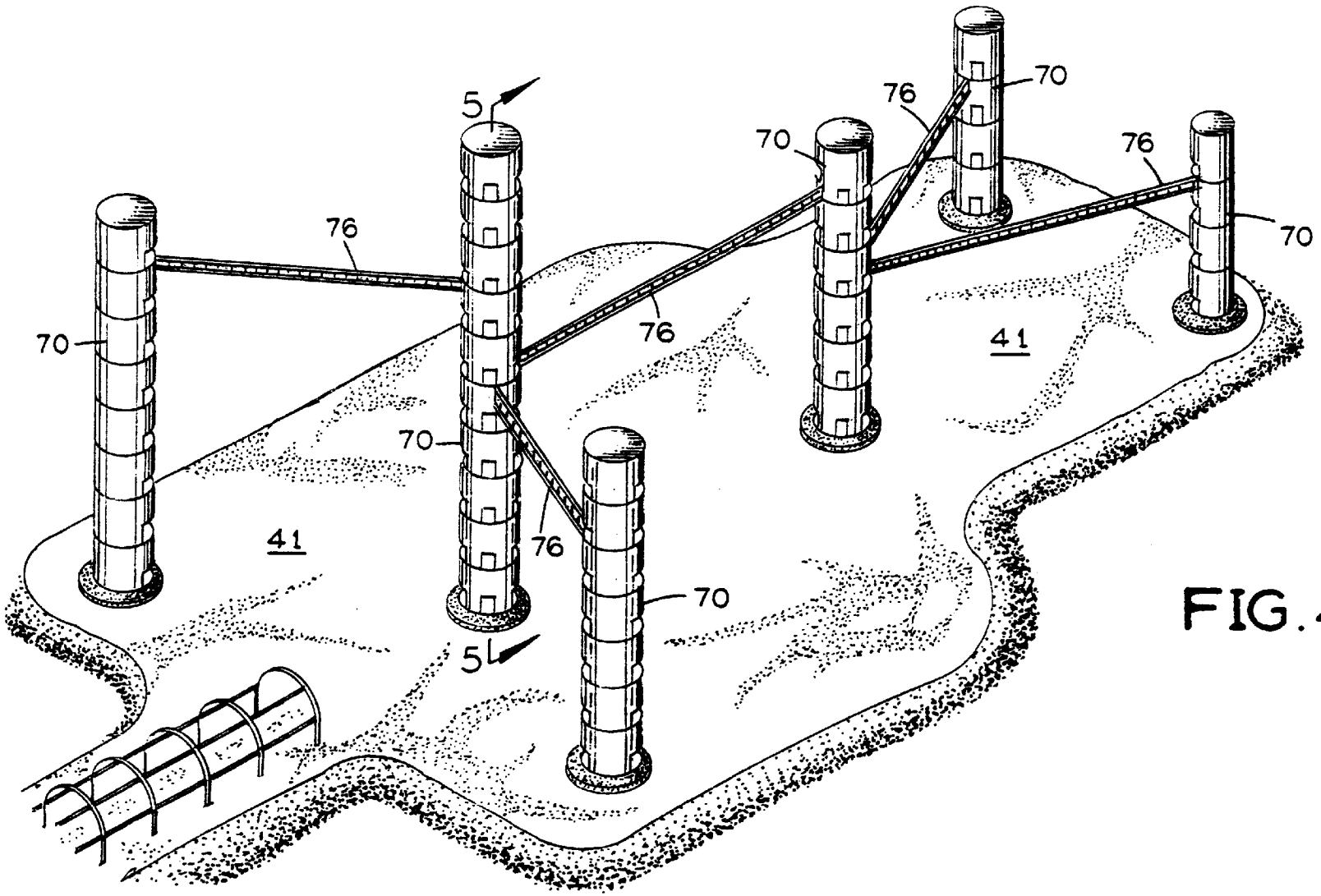
FIG. 4 is a perspective view of the second housing, in partial section, showing the columns and support beams.
Figure 5:
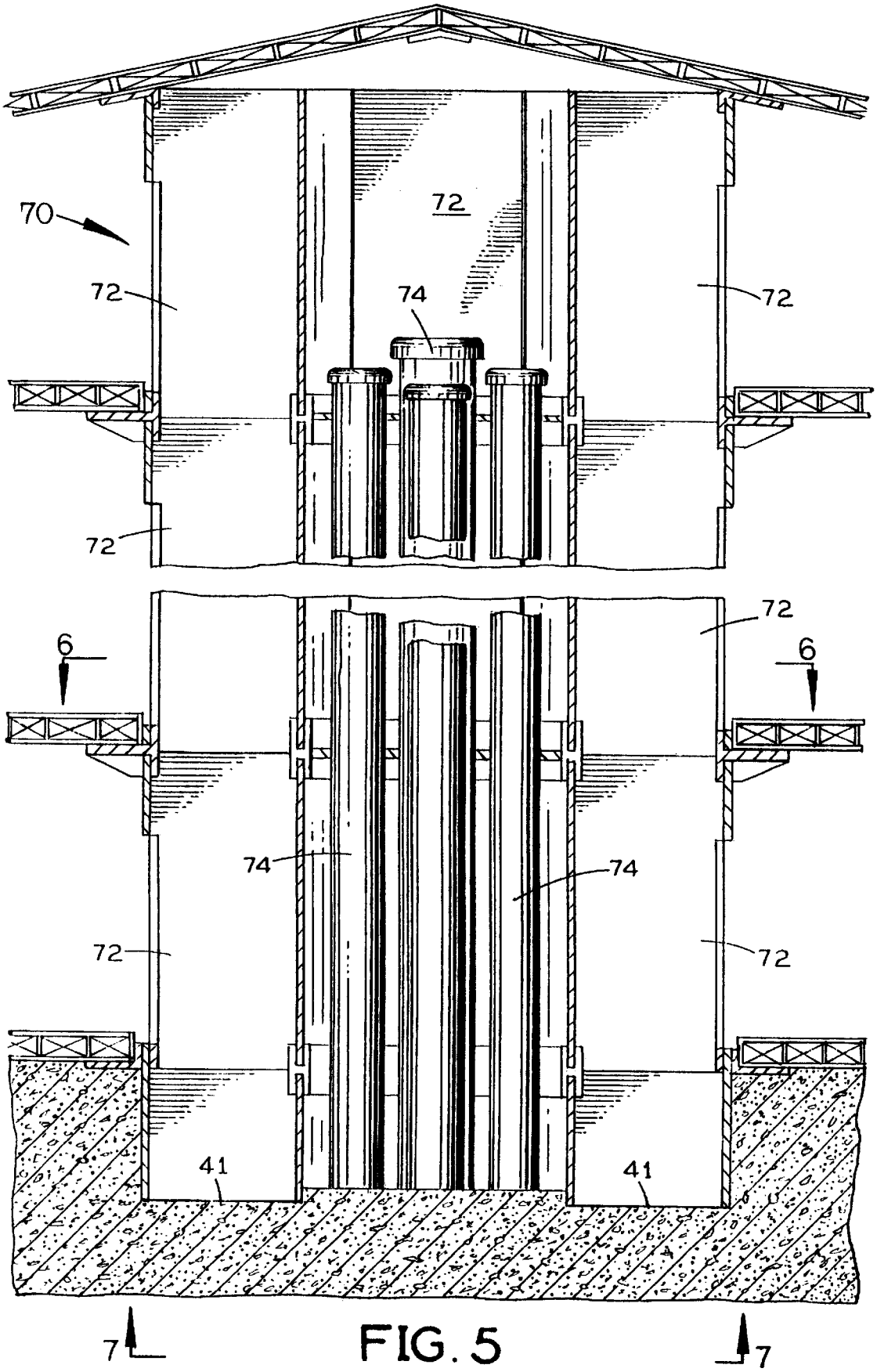
FIG. 5 is a cross sectional view of a column, taken across the line 5—5 of FIG. 4, showing the interior of the column.
Figure 6:
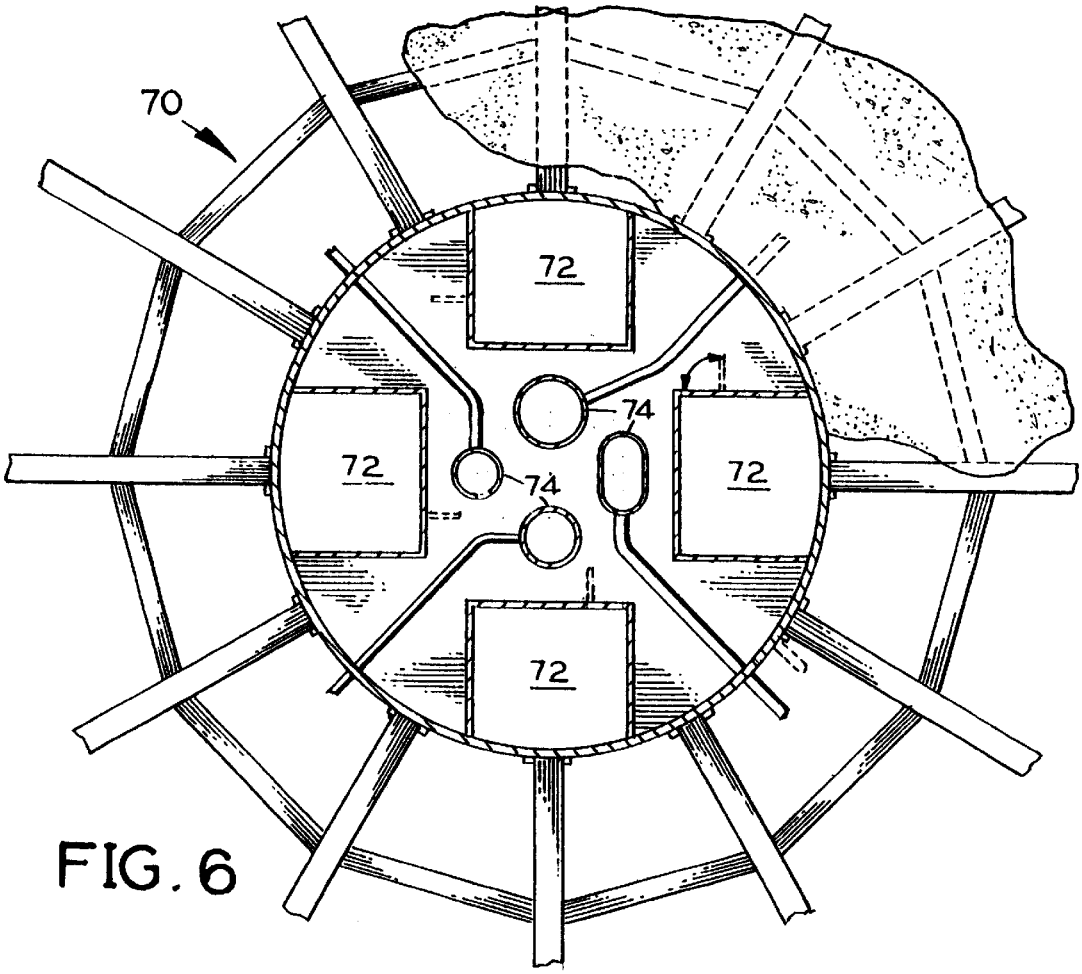
FIG. 6 is a cross sectional view of a column, taken across the line 6—6 of FIG. 5, showing the elevators, conduits and support beams.
Figure 7:
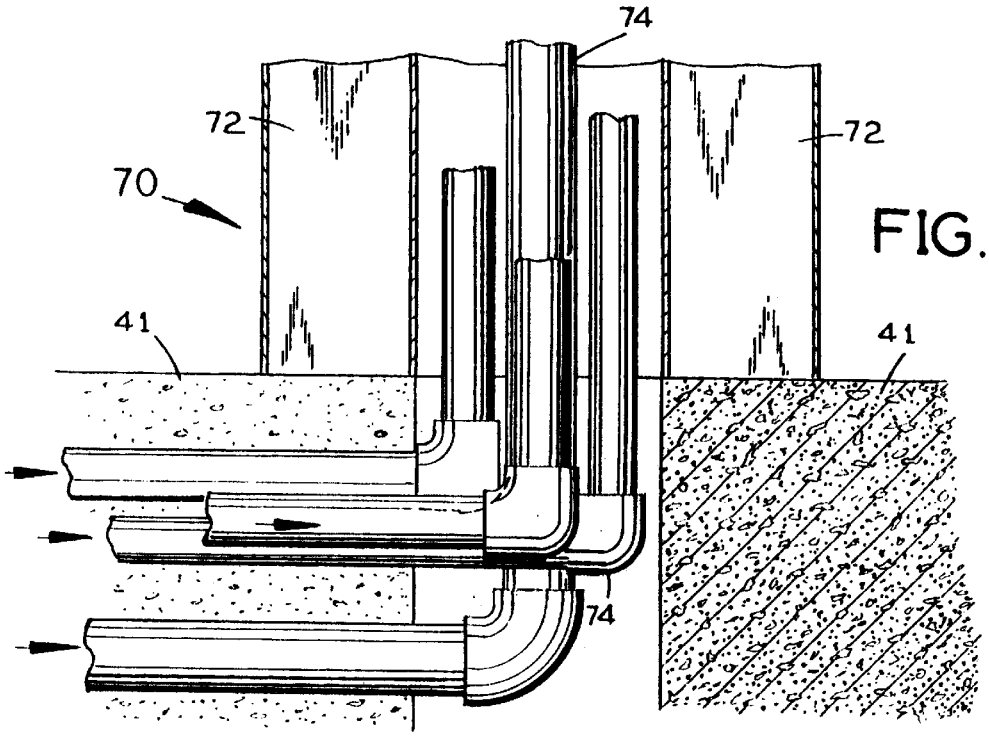
FIG. 7 is a cross sectional view of a column, taken across the line 7—7 of FIG. 6, showing the conduits entering the columns.
Figure 9:
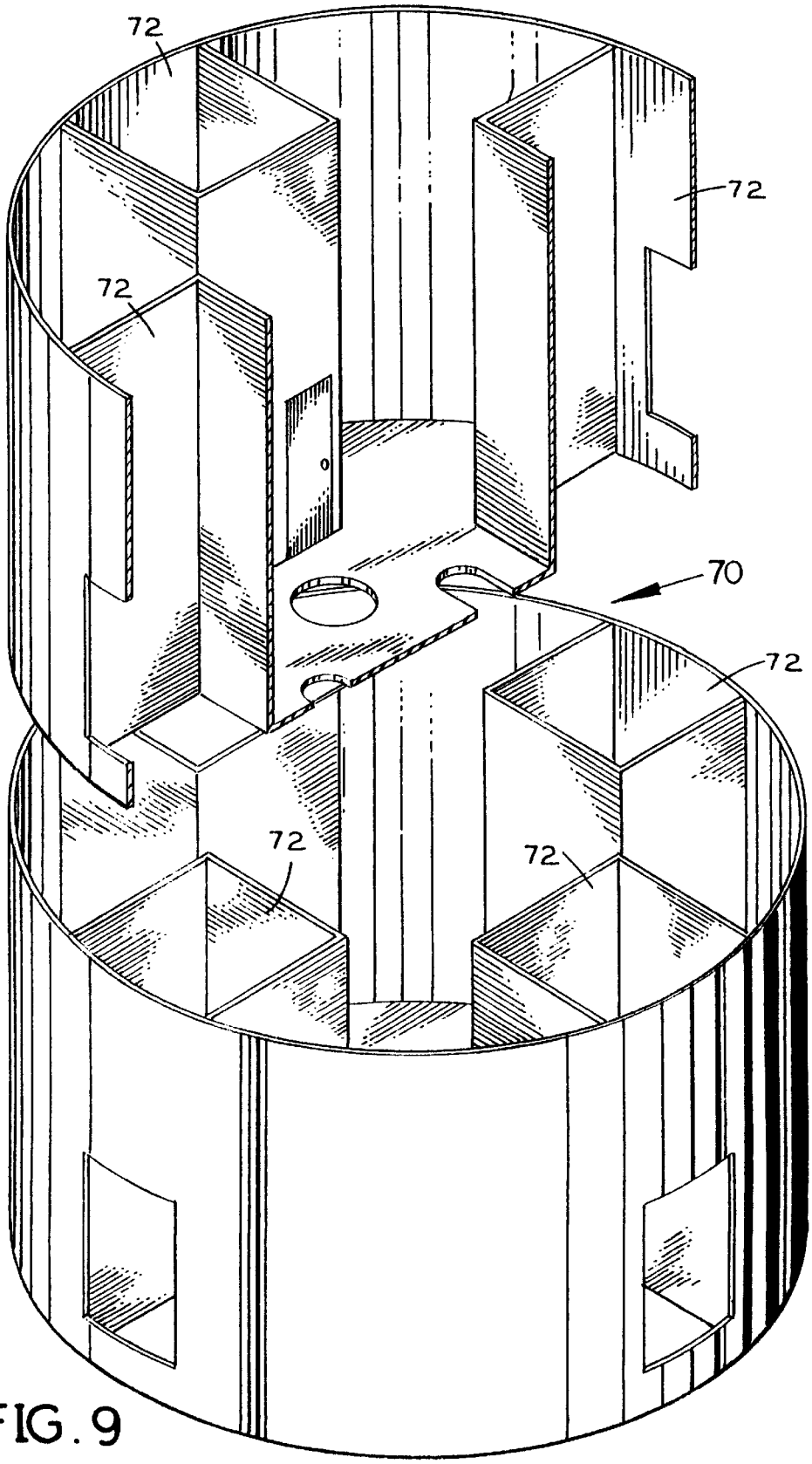
FIG. 9 is a perspective view of a column, in partial section.

Referring now to FIGS. 2, 4–7 and 9, the second housing 40 further includes a plurality of generally vertically disposed, annular-shaped columns 70. The columns 70 are structured to serve several purposes. First, each column 70 includes a plurality of elevators 72 for transporting people between the several levels and a plurality of conduits 74 for running electrical wires and plumbing pipes. Second, the columns 70 provide structural support for the generally domed-shaped structure. As shown in FIG. 2, the columns 70 extend from the foundation 41 towards the top 43 of the second housing 40. The precise height of each of the columns 70 is based upon the actual configuration of the second housing 40 and will be determined by structural engineers. Third, the columns 70 provide structural support for the floors in the second housing 40. Referring to FIG. 4, a plurality of generally horizontally disposed support beams 76 extend between the columns 70. The support beams 76 are disposed as necessary to provide structural support for the floors.

The second housing 40 is also situated within the body of water 12 so that a first portion 50 is disposed within the body of water 12 resting on the bottom thereof, and a second portion 51 is disposed above the body of water 12. Like the first housing 20, the precise apportionment of the first 50 and second portions 51 may vary to accommodate the detailed design criteria.

The interior of the second housing 40 is divided into a plurality of levels and, like the first housing 20, may include an entranceway/lobby, guest quarters, restaurants and entertainment facilities, a casino and other hotel amenities, such as health clubs swimming pools, beauty salons, retail shops, etc. It should also be appreciated that the precise configuration of the second housing 40 and the facilities included therein may vary to accommodate the specific usage desired.

Access to the second housing 40 is provided by a generally tubular-shaped enclosure 52 having a first end 53 interconnected to the second housing 40 and an opposite second end 54 interconnected to the shore 14. The enclosure 52 is structured to transport people between the second housing 40 and the shore 14 via one or more motorized vehicles operating on a conventional roadway or tram-like vehicles operating on a track. The upper portion of the enclosure 52 is preferably transparent so that persons entering and exiting the second housing 40 may view the entire complex 10 from therein.

Access between the first 20 and second 40 housings is provided by a generally tubular-shaped tunnel 60. The tunnel 60 includes a first end 62 interconnected to the first housing 20 and an opposite second end 64 interconnected to the second housing 40. The tunnel 60 may be disposed either within or above the body of water 12. The tunnel 60 is structured to transport people between the first 20 and second 40 housings via one or more motorized vehicles operating on a conventional roadway or tram-like vehicles operating on a track. A portion of the tunnel 60 is preferably transparent so that persons traveling therein may view the surroundings.

While tie invention has been described, disclosed, illustrated and shown in various terms of certain embodiments or modifications, which it has presumed in practice, the scope of the invention is not intended to be, nor should it be deemed to be, limited thereby and such other modifications or embodiments as may be suggested by the teachings herein are particularly reserved, especially as they fall within the breadth and scope of the claims here appended.

What is claimed is:

1. A building complex comprising:

a body of water surrounded by a shore and a bottom;

a housing structured to resemble a ship, secured within said body of water so that a first portion of said housing is disposed within said body of water resting on the bottom thereof and a second portion of said housing is disposed above said body of water, said housing including a plurality of partitions structured to divide said housing into a plurality of levels and a plurality of rooms within each level;

and means for ingress and egress between said housing and said shore; and a second housing structured to resemble an iceberg, secured within said body of water so that a first portion of said second housing is disposed within said body of water resting on the bottom thereof and a second portion of said second housing is disposed above said body of water, said second housing including a plurality of partitions structured to divide said second housing into a plurality of levels and a plurality of rooms within each level.

2. The building complex claimed in claim 1, further comprising:

means for ingress and egress between said housings.

3. The building complex claimed in claim 1 comprising: means for ingress and egress between said second housing and said shore.

4. A building complex comprising:

a housing structured to resemble a ship, said housing including a plurality of partitions structured to divide said housing into a plurality of levels and a plurality of rooms within each level, an additional housing having rooms, and said additional housing simulating an iceberg.

5. A building complex comprising:

a housing structured to resemble a ship, said housing including a plurality of partitions structured to divide said housing into a plurality of levels and a plurality of rooms within each level, an additional housing having rooms, and said additional housing is in the shape of an iceberg.

* * * * *